US007444938B2

(12) United States Patent
Tippmann

(10) Patent No.: US 7,444,938 B2
(45) Date of Patent: Nov. 4, 2008

(54) PAINTBALL GRENADE

(75) Inventor: Benjamin Tippmann, Fort Wayne, IN (US)

(73) Assignee: KEE Action Sports I LLC, Sewell, NJ (US)

( * ) Notice: Subject to any disclaimer, the term of this patent is extended or adjusted under 35 U.S.C. 154(b) by 509 days.

(21) Appl. No.: 11/264,362

(22) Filed: Nov. 1, 2005

(65) Prior Publication Data

US 2006/0156943 A1 Jul. 20, 2006

Related U.S. Application Data

(60) Provisional application No. 60/623,932, filed on Nov. 1, 2004.

(51) Int. Cl.
*F42B 12/40* (2006.01)

(52) U.S. Cl. ..... 102/498; 102/513; 473/594; 473/603; 446/267; 273/457

(58) Field of Classification Search ..... 102/498, 102/513, 529; 473/594, 603; 446/267; 273/457, 273/458
See application file for complete search history.

(56) References Cited

U.S. PATENT DOCUMENTS 4,212,460 A * 7/1980 Kraft ..... 473/577
4,684,137 A * 8/1987 Armer et al. ..... 473/609
4,932,672 A 6/1990 Tippmann
5,018,449 A 5/1991 Eidson, II
5,240,450 A * 8/1993 Graham ..... 446/267
5,356,327 A * 10/1994 Gill, III ..... 446/220
5,538,456 A * 7/1996 Liu et al. ..... 446/473
5,590,886 A 1/1997 Lush
5,831,199 A 11/1998 McNulty, Jr. et al.
5,967,916 A 10/1999 Robeson
5,975,983 A * 11/1999 Panec ..... 446/475
6,223,658 B1 5/2001 Rosa et al.
6,242,489 B1 6/2001 Pinney
6,289,819 B1 9/2001 Dolderer
6,302,028 B1 * 10/2001 Guillot-Ulmann et al. .. 102/502
6,352,032 B1 3/2002 Pinney
6,386,113 B1 5/2002 Pinney
6,450,100 B1 9/2002 Carson
6,453,819 B1 9/2002 Coates
6,532,947 B1 3/2003 Rosa et al.
6,581,521 B1 6/2003 Dixon et al.
6,598,807 B1 7/2003 Anzalone
2004/0127311 A1 * 7/2004 Brock ..... 473/577

OTHER PUBLICATIONS

Major Paintball Wet Willie™ G-4 Paint Grenade; internet page, Mar. 37, 2006.
Pioneer Laboratories Meteor Shower Grenade; internet page, Mar. 27, 2006.
P&D Paintball Ordinance, Inc. Assault Grenade; internet page, Mar. 27, 2006.

* cited by examiner

*Primary Examiner*—James S Bergin
(74) *Attorney, Agent, or Firm*—Volpe and Koenig P.C.

(57) ABSTRACT

A paintball grenade having an outer bladder and an inner bladder. The outer bladder has a first open end, an opposite second open end, and a cavity therethrough. The inner bladder has a closed end and an open end. The inner bladder is capable of being inserted into the outer bladder whereby the open end is adjacent the first open end of the outer bladder, and the closed end is adjacent the second open end of the outer bladder, the inner bladder being filled with a colored liquid. A securing element is used to secure the first open end of the outer bladder and the open end of the inner bladder.

6 Claims, 11 Drawing Sheets

PAINTBALL GRENADE

CROSS REFERENCE TO RELATED APPLICATION

This application claims priority to U.S. Provisional Patent Application No. 60/623,932 filed Nov. 1, 2004, which is incorporated herein by reference in its entirety.

FIELD OF INVENTION

The present invention is directed to the field of grenades used for sport that contain paint or dye, and are used for marking an opposing player.

BACKGROUND

The sport of paintball is a popular "combat style" game played by players using guns (called markers) that fire projectile (paintballs) using compressed gas. The paintballs are substantially spherical capsules, filled with a washable colored liquid, such as non-toxic paint, dye or food coloring. The sport is played whereby players are split into teams, and players seek to capture an opposing team's flag. Once a player is struck with a paintball and marked, that player is out. Thus, a goal is to mark an opposing player with paint or dye.

These war games have increased in popularity and sophistication resulting in more elaborate equipment. In addition to paintball markers, other devices have been developed to mark paintball sport players. Thus, paintball mines and paintball grenades for spreading paint or dye exist, having various undesirable properties. Some known paintball grenades require complicated assemblies that are cost prohibitive, and are difficult to assemble. Other known paintball grenades are formed from a single rubber bladder. In addition, other known paintball grenades do not always rupture when thrown.

SUMMARY

One aspect of the present invention is directed to a paintball grenade having an outer bladder and an inner bladder. The outer bladder has a first open end, an opposite second open end, and a cavity therethrough. The inner bladder has a closed end and an open end. The inner bladder is capable of being inserted into the outer bladder whereby the open end is adjacent the first open end of the outer bladder, and the closed end is adjacent the second open end of the outer bladder, the inner bladder being filled with a colored liquid. A securing element is used to secure the first open end of the outer bladder and the open end of the inner bladder.

Another aspect of the present invention is directed to a method of forming a paintball grenade. The method comprises providing a an outer bladder having a first open end and a second open end, the outer bladder having a cavity therethrough; inserting an inner bladder having an open end and a closed end into the outer bladder whereby the open end is adjacent the first open end of the outer bladder, and the closed end is adjacent the second open end of the outer bladder; filling the inner bladder with a colored liquid via its open end; and securing the open end of the inner bladder and the first open end of the outer bladder concurrently with a securing element.

DETAILED DESCRIPTION OF THE PREFERRED EMBODIMENT

Figure 1:
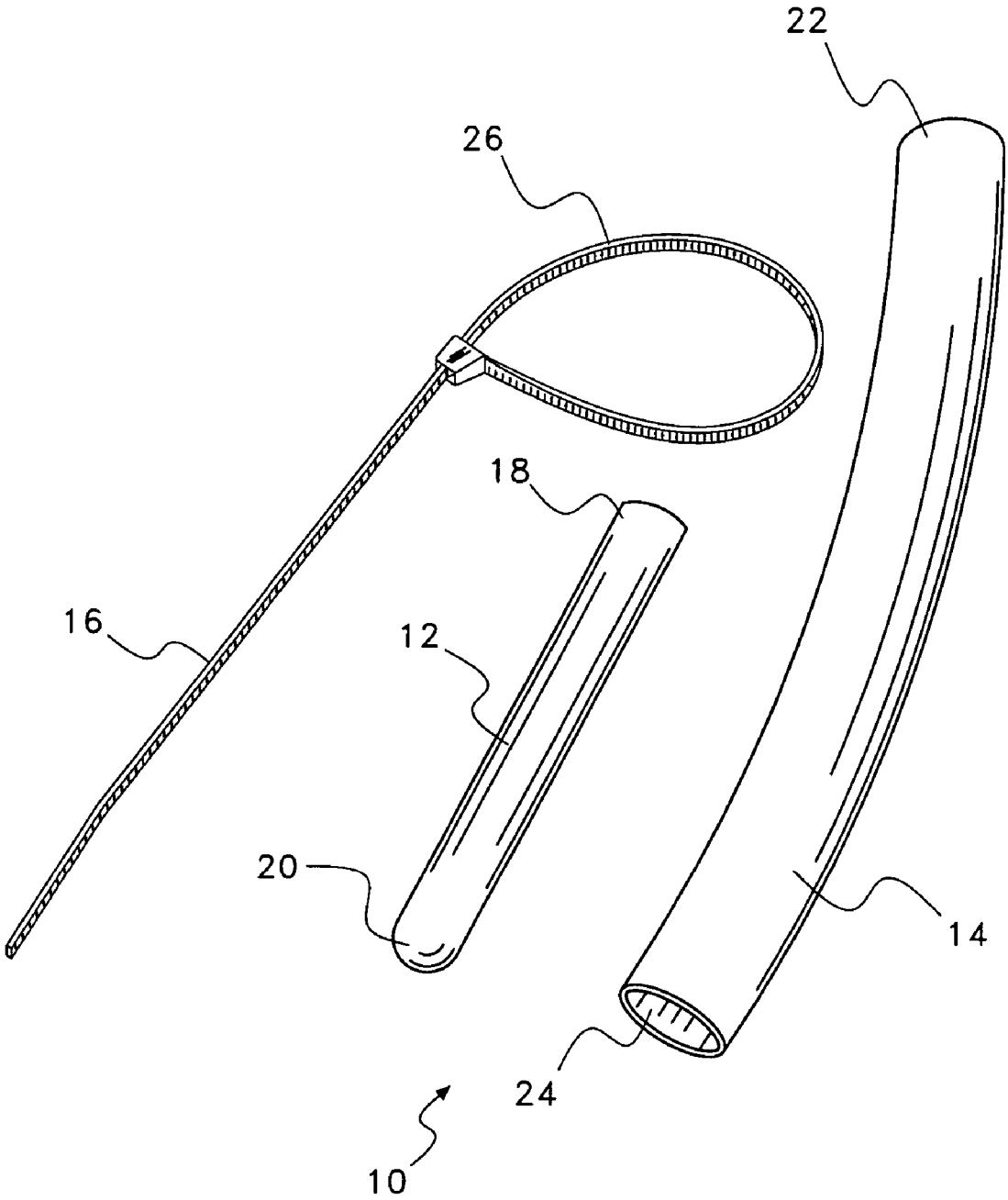
FIG. 1 shows disassembled components of a paintball grenade according to the present invention.
Figure 2:
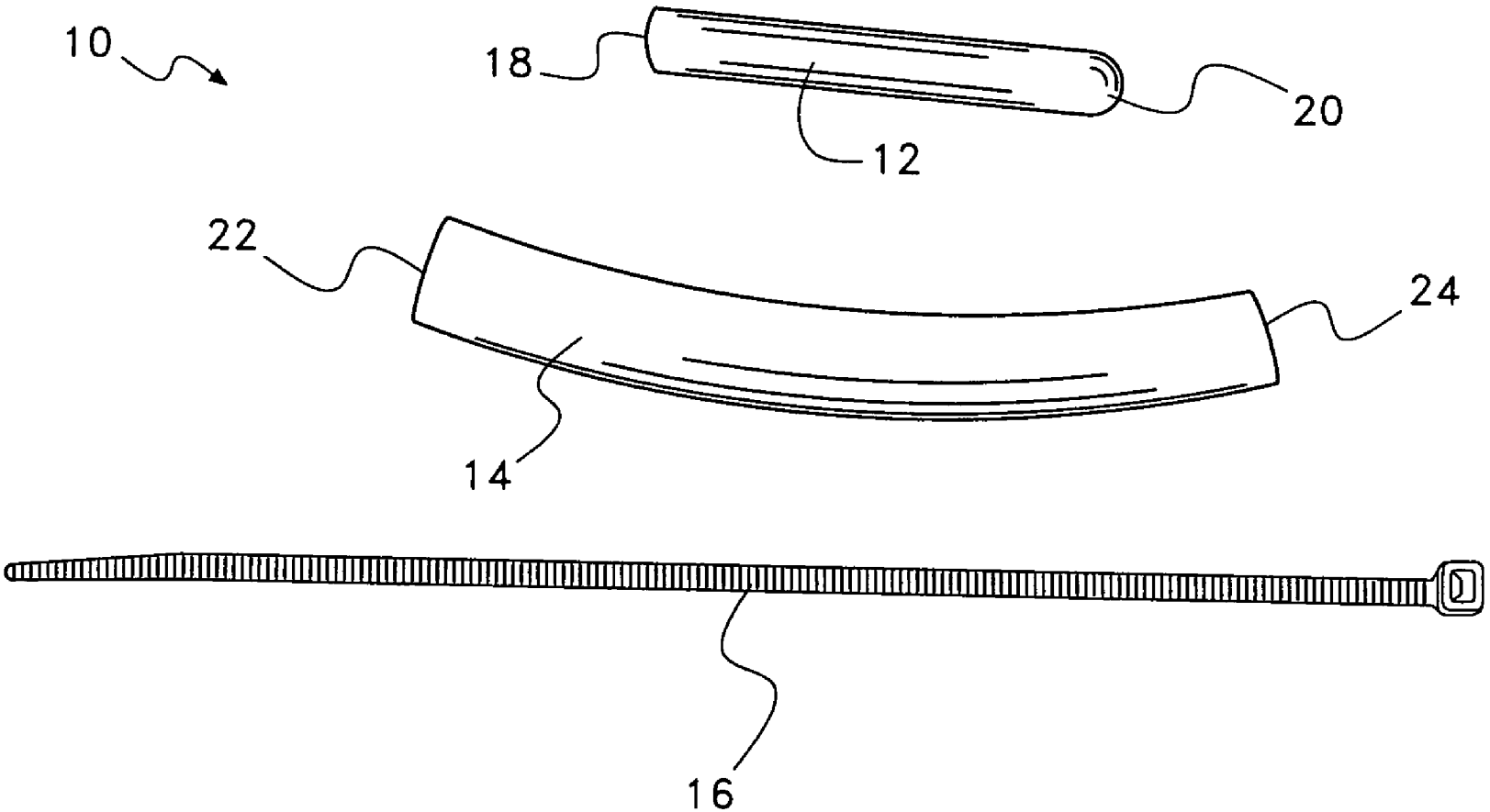
FIG. 2 shows disassembled components of a paintball grenade according to the present invention.
Figure 3:
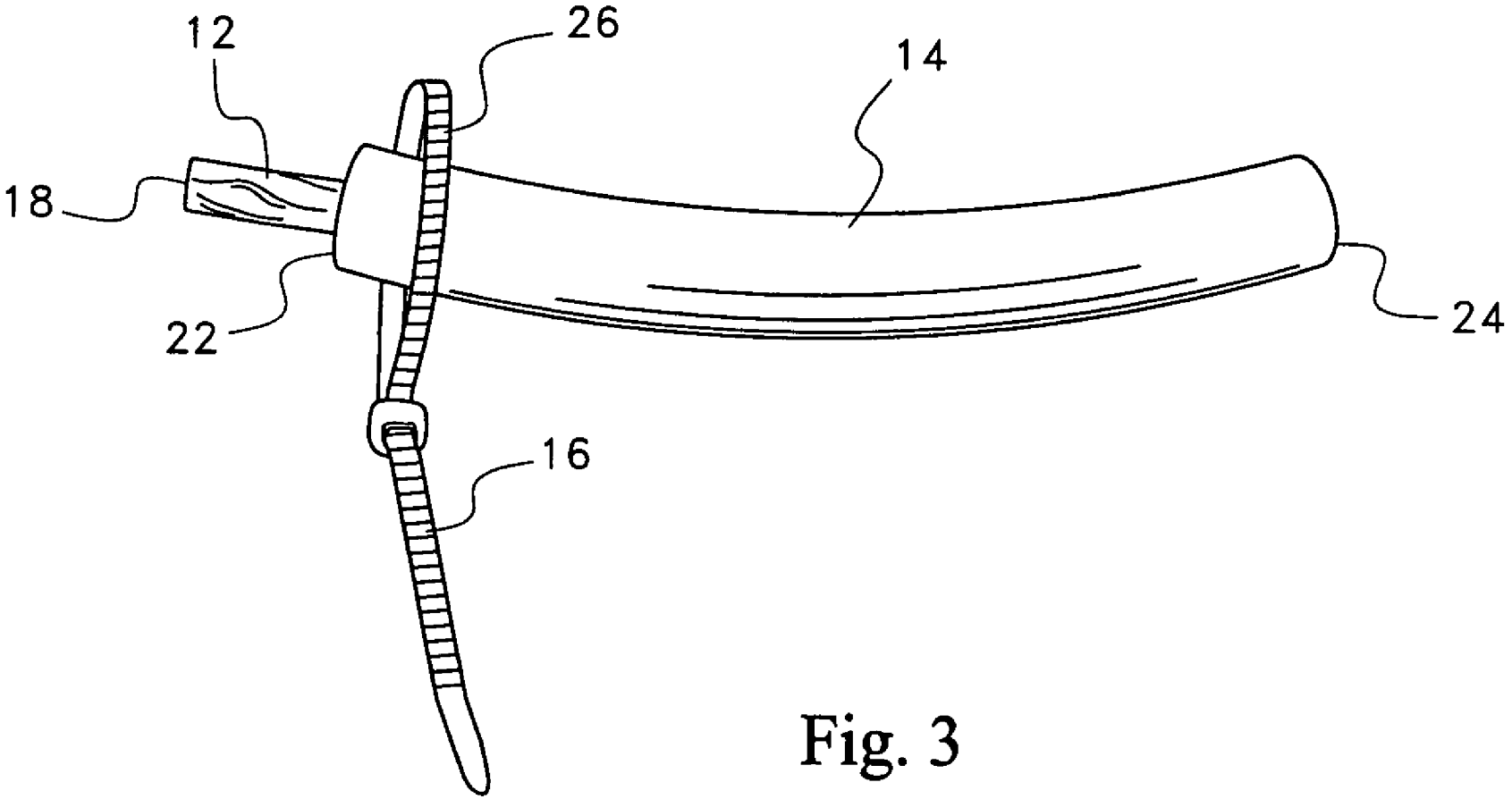
FIG. 3 shows a partially assembled paintball grenade according to the present invention, that is not yet filled.

A paintball grenade 10 according to the present invention includes an inner bladder 12 and an outer bladder 14, as shown in FIGS. 1 and 2. The inner bladder 12 is formed from a flexible material such as rubber, silicone rubber, latex, PVC, or an acceptable elastic substitute, that will deform when filled with an appropriate colored liquid 42, such as a paintball dye or paint, as explained in more detail below. As shown in FIGS. 1 and 2, the inner bladder 12 has an open end 18 and closed at its closed end 20. In one embodiment, the inner bladder 12 may be preferably approximately 3-5 inches in length, and formed from a balloon, such as a latex rubber toy balloon, although any elastic bladder will do. The inner bladder 12 has a cavity 34, or lumen, adapted to receive a colored liquid 42, paint, food coloring or dye ("colored liquid 42").

An outer bladder 14 is provided as an open-ended tube. The outer bladder 14 has a first end 22 and a second end 24. The outer bladder 14 may be formed from a flexible latex rubber tube having a first open end 22 and a second open end 24. One of the ends 22, 24 may be closed in an alternate embodiment. The outer bladder 14 is formed from a tube of flexible material such as rubber, silicone rubber, latex, PVC, or an acceptable elastic substitute. Preferably, the outer bladder if of a heavier gauge material than the inner bladder 12. The outer bladder 14 has a cavity 36, or lumen, adapted to accommodate the inner bladder 12, so that the inner bladder 12 may be inserted into the cavity 36 of the outer bladder 14 through one of the ends 22, 24 of the outer bladder 14, so that the outer bladder 14 coaxially surrounds at least part of the inner bladder 12. In a preferred embodiment, the outer bladder 14 is formed from rubber tubing, and may be approximately 4-8 inches in length.

The diameter of the cavity 36 of the outer bladder 14 wall is sized and dimensioned to receive the inner bladder 12. The walls of the outer bladder 14 are preferably of a heavier gauge, or thicker size, than the walls of the inner bladder 12, such that the walls of the outer bladder 14 resist deformation to a greater degree than the walls of the inner bladder 12. The paintball grenade 10 of the present invention may be sized to any preferable length for use in the sport of paintball, and to accommodate any amount of colored liquid 42. Rubber tubing of different wall thicknesses may be used depending on a user's preference regarding ability of the grenade 10 to rupture.

Figure 6:
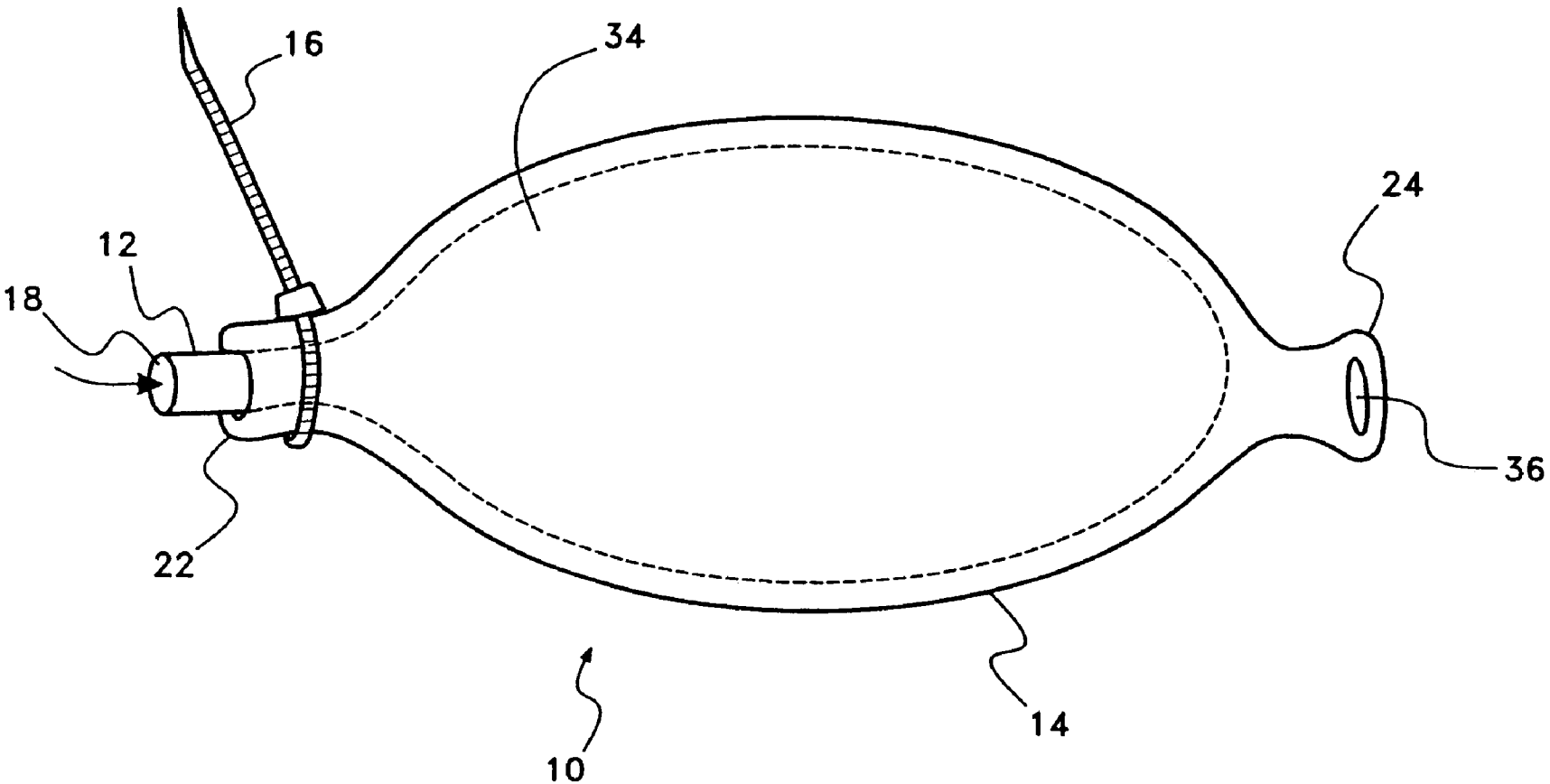
FIG. 6 shows a paintball grenade according to the present invention with the inner bladder inflated by colored liquids, and a securing element securing one end of the paintball grenade.
Figure 7:
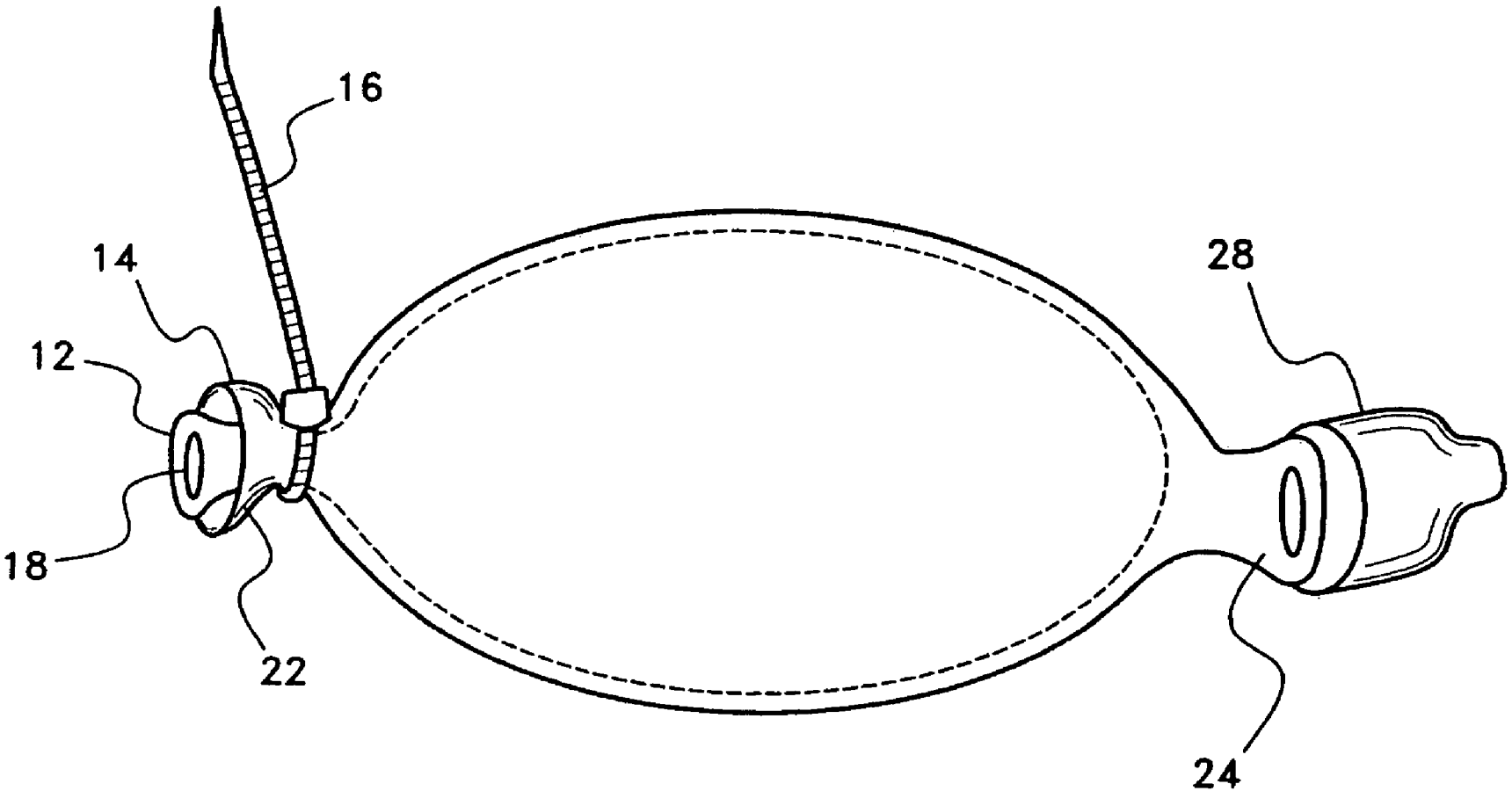
FIG. 7 shows the paintball grenade of FIG. 6, with a securing element at one end, and a cap being fitted over an opposite end.

To form a paintball grenade according to an embodiment of the present invention, the inner bladder 12 is inserted into the cavity 36 of the outer bladder 14, with the closed end 20 entering the cavity 36 first, as shown in FIGS. 6-7, with the open end 18 of the inner bladder 12 adjacent the first end 22 of the outer bladder 14, and with the closed end 20 of the inner bladder 12 adjacent the second end 24 of the outer bladder 14.

Figure 4:
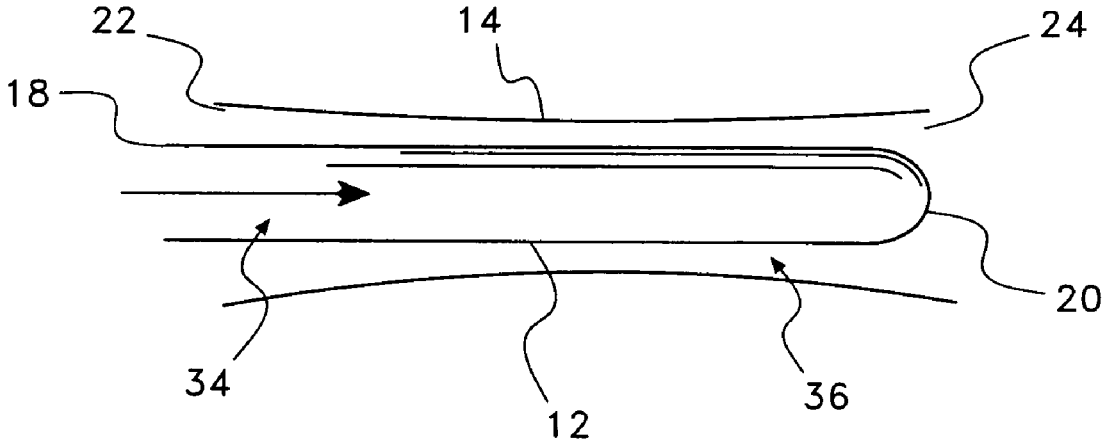
FIG. 4 shows a schematic cross sectional view of an inner bladder of a paintball grenade according to the present invention disposed within an outer bladder of a paintball grenade according to the present invention, showing the direction of paint or dye filling the inner bladder.
Figure 5:
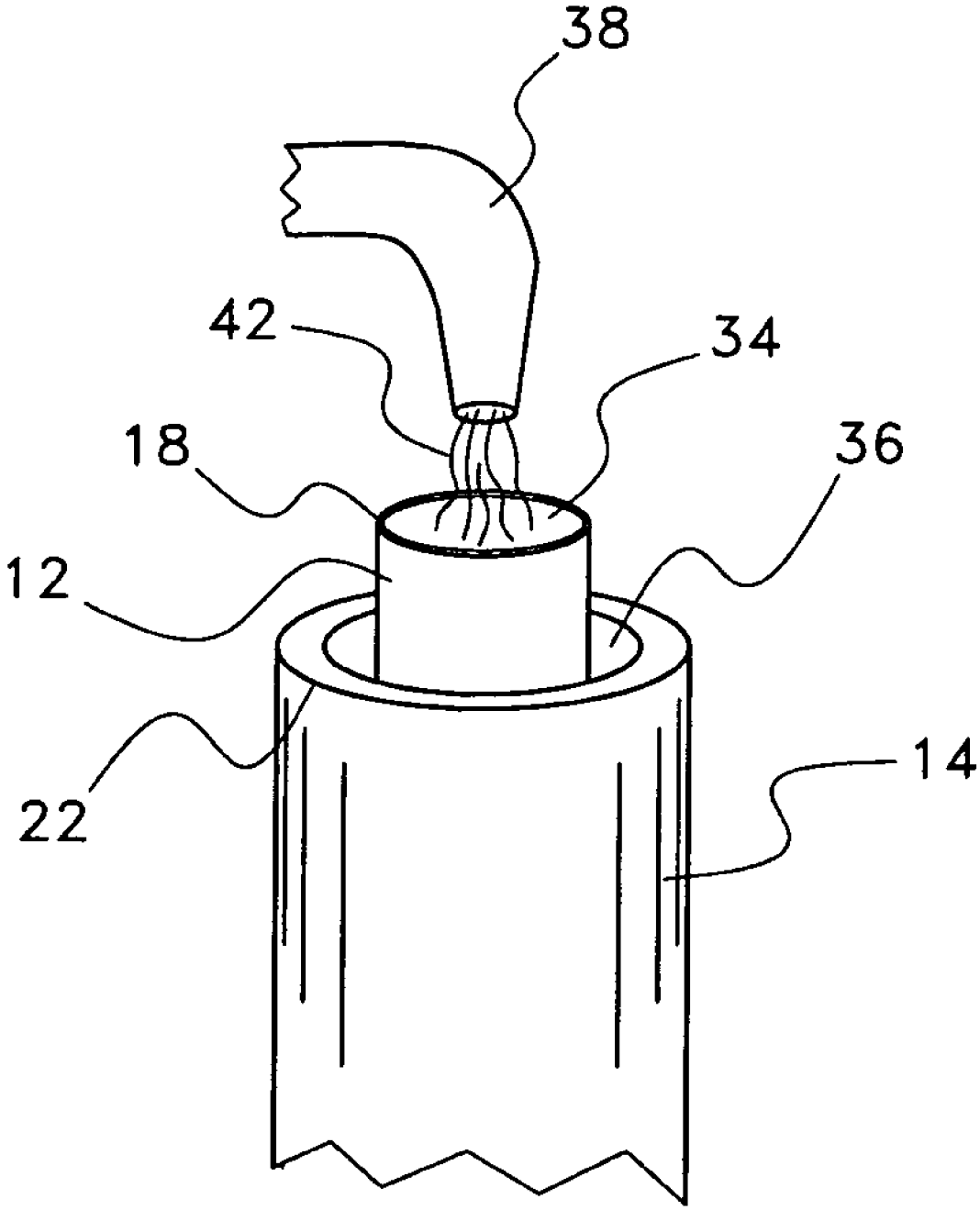
FIG. 5 shows an end of a paintball grenade of the present invention being filled with a colored liquid.

The inner bladder 12 is filled at its open end 18 with a colored liquid 42 such as paintball paint (or dye, or food coloring, or any other suitable marking liquid), or any other suitable colored liquid 42 as is known in the art, as depicted by the direction of the arrow shown in FIGS. 4 and 6. By way of example, a fill tube or hose 38 is inserted into the open end 18 of the inner bladder 12, and colored liquid 42 is pumped into the inner bladder 12. The inner bladder 12 expands as it is filled with colored liquid 42, applying pressure against the walls of the inner bladder 12, and forcing the inner bladder 12 against the walls of the outer bladder 14. The outer bladder 14 will expand at a slower rate than the inner bladder 12, and the wall of the inner bladder 12 will press against the walls of the outer bladder 14 when the cavity 34 of the inner bladder 12 is filled with colored liquid 42. The colored liquid 42 provides hydrostatic pressure against the walls of the inner bladder 12 and the walls of the outer bladder 14.

As the paintball grenades 10 are designed for being thrown or directed at persons, it is desirable that the colored liquid 42 be of a type that is easily washable from clothing and skin. It is also desirable for the coloring agent to be non-toxic. Food dye or a combination of food dye and polyethylene glycol (PEG) may be used. In one embodiment, vegetable dye such as food coloring is used as the coloring agent. Those persons skilled in the art will readily appreciate that other dyes or colored chalk would provide a suitable and acceptable substitution.

In one embodiment of the present invention, when the cavity 34 of the inner bladder 12 has been filled with colored liquid 42, the open end 18 of the inner bladder 12 and the first end 22 of the outer bladder are closed together, by a securing element 16, as shown in FIGS. 6 and 7. For example, a standard plastic electrical or cable tie ("tie") may be used, as shown in FIGS. 1, 2, 6 and 7. The securing element 16 is formed into a loop 26 for closing the open end 18 of the inner bladder 12 and the first end 22 of the outer bladder 14. It is appreciated that any type of closure may be used to close the ends 18, 22 and may be substituted for the securing element 16, such as wire closures, plastic twist closures, elastic bands, clamps, or other suitable substitutes. The securing element 16 should provide a substantially leak-proof closure that will retain the colored liquid 42 within the cavity 34 of the inner bladder 12.

The open end 18 of the inner bladder 12 may be folded back or crimped prior to being closed by the securing element 16. In one embodiment, the first end 22 of the outer bladder 14 and the open end 18 of the inner bladder 12 are closed with separate securing elements 16.

Figure 8:
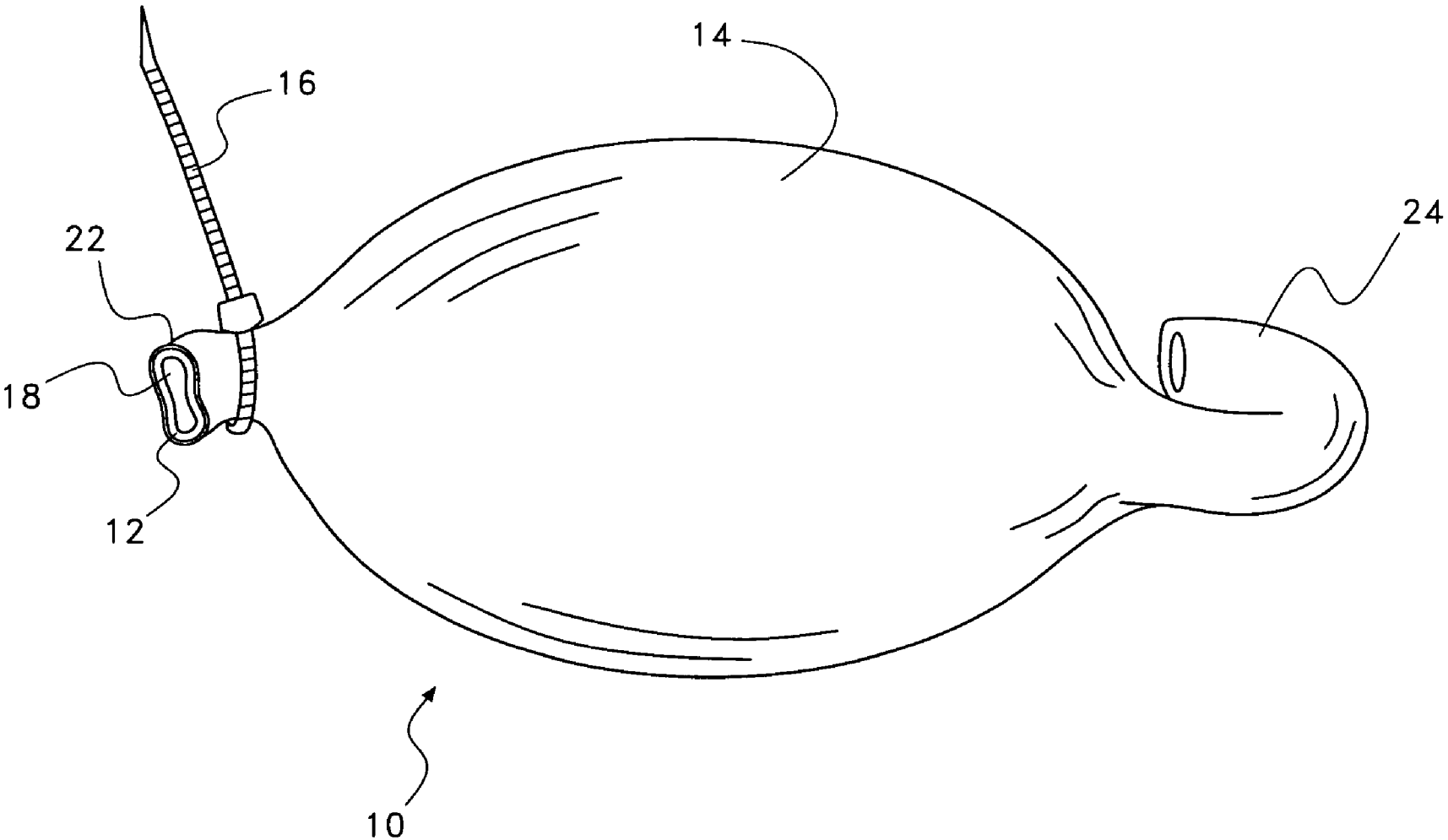
FIG. 8 shows a paintball grenade according to the present invention filled with paint and, with one end secured by a securing element, and the opposite end crimped for receiving a cap.
Figure 9:
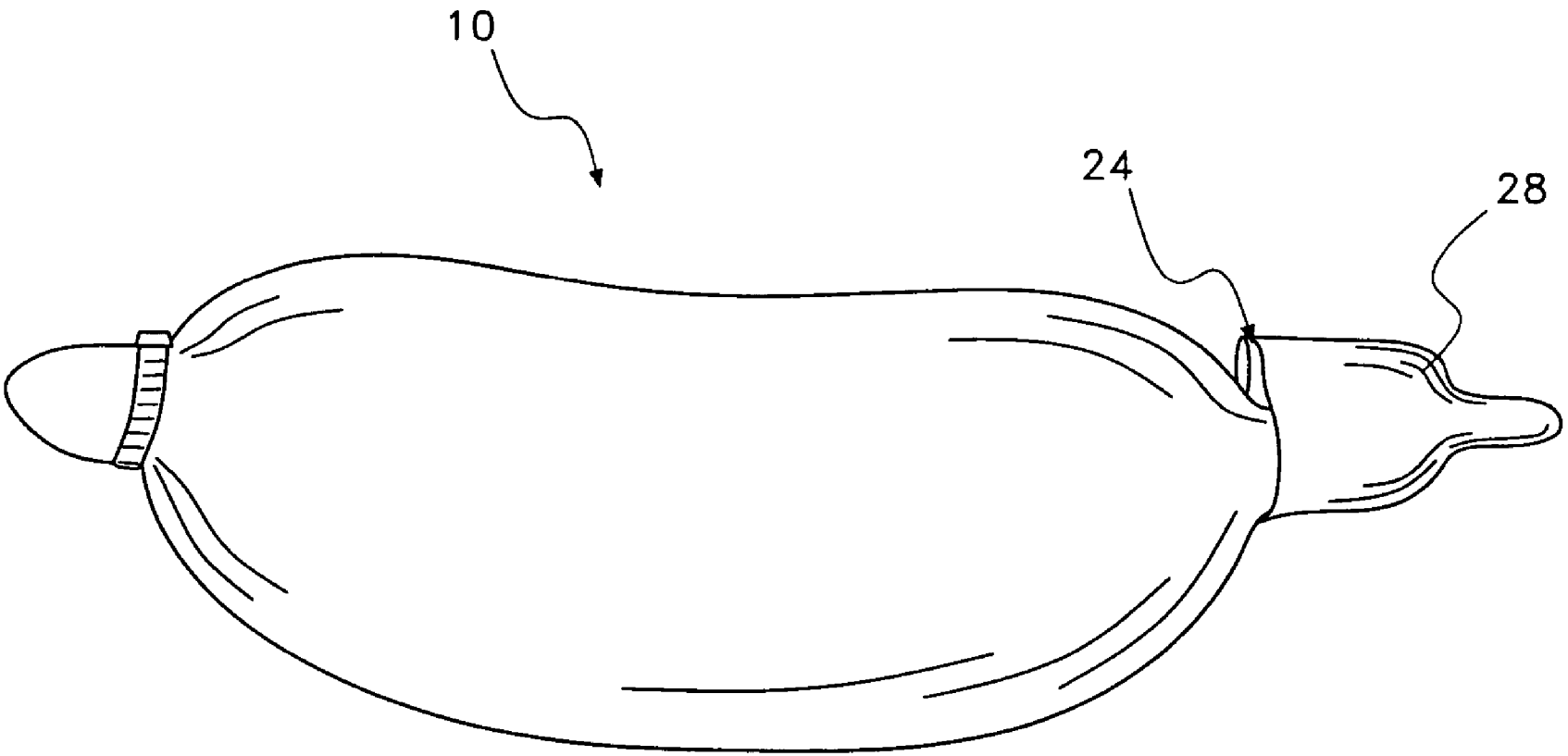
FIG. 9 shows an embodiment of an assembled paintball grenade according to the present invention, with one end tied, and the opposite end crimped and capped.
Figure 10:
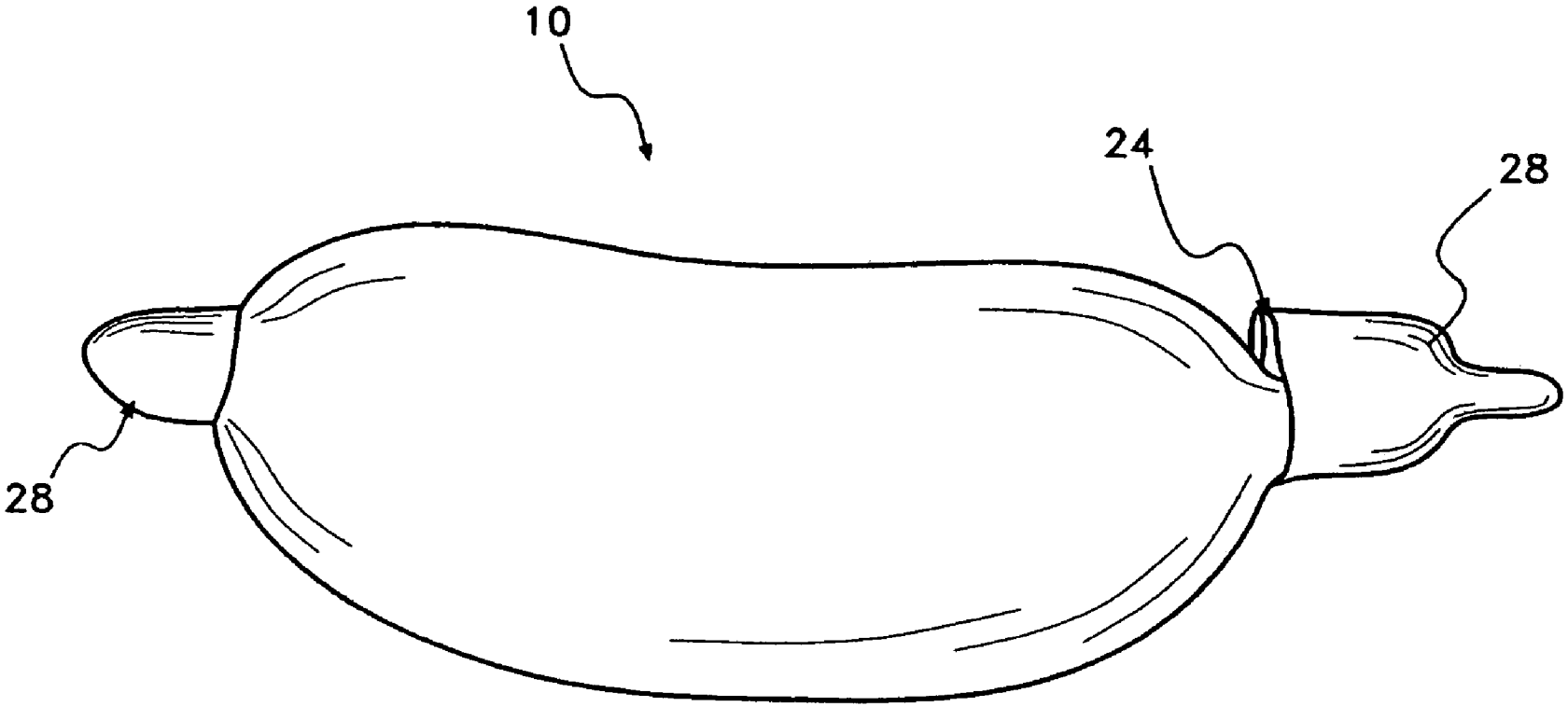
FIG. 10 shows a paintball grenade according to an embodiment of the present invention, with both ends capped.

The second end 24 of the outer bladder 14 is either secured with a cap 28, or folded back upon itself or crimped and secured with a cap 28, as shown in FIGS. 8 and 9. As shown in FIG. 10, a cap 28 can be used to secure both ends 22, 24 of the outer bladder 14. The cap 28 is formed from a molded plastic or other acceptable elastic material that will grip the folded portion of the end 24 of the outer bladder 14. The cap 28 should frictionally engage at least one of ends 22, 24 of the outer bladder 14 so that the cap 28 does not accidentally fall off prior to being thrown. The cap 28 is used partially for appearance, since the securing element 16 acts to maintain the colored liquid 42 within the bladders 12, 14.

Figure 11:
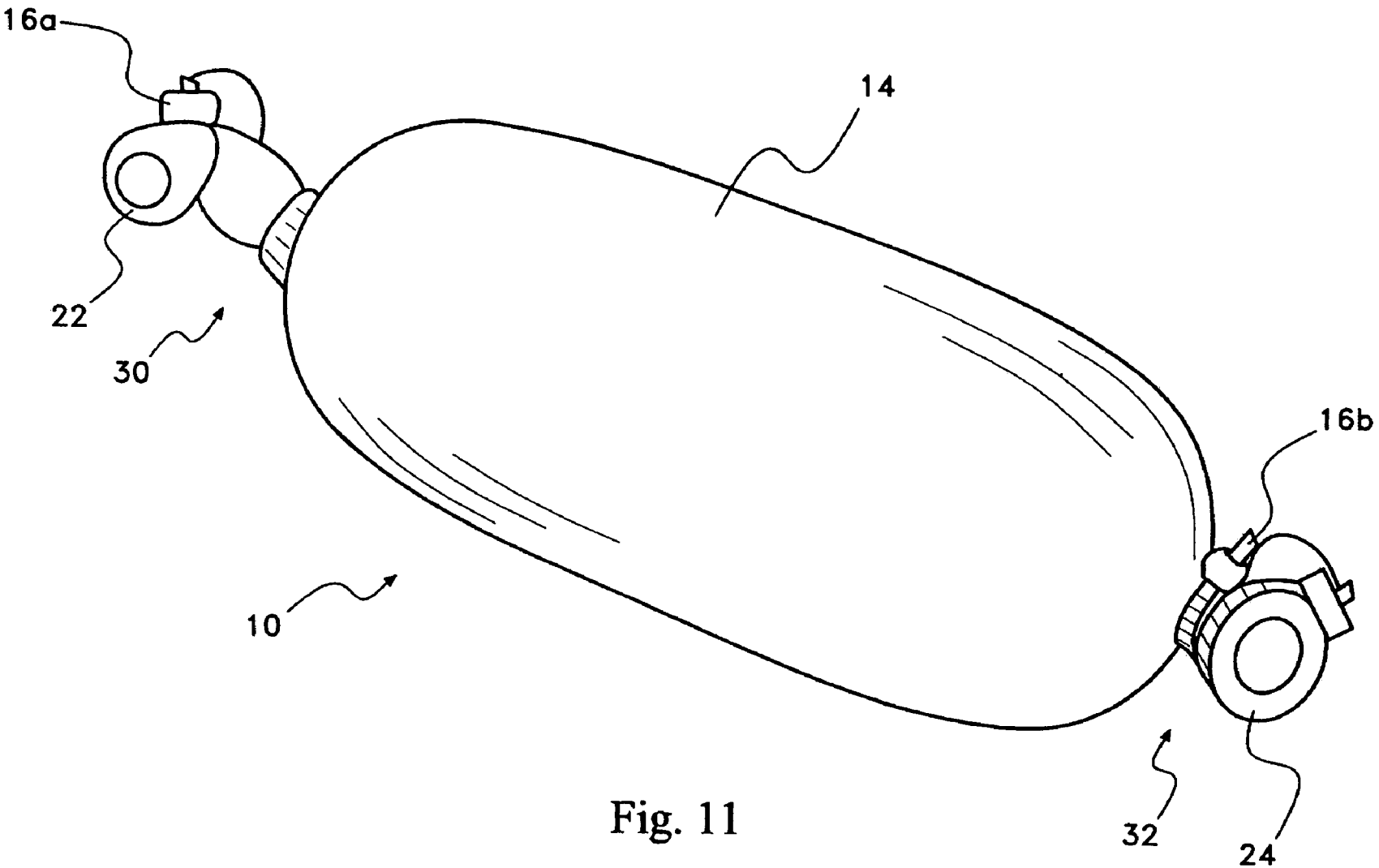
FIG. 11 shows another embodiment of a grenade according to the present invention.

In another embodiment of the present invention, as shown in FIG. 11, the grenade 10, is secured with securing elements 16 at its first 30 and second 32 ends. The open end 18 of the inner bladder and first end 22 of the outer bladder 14 are crimped or folded, as shown in FIG. 11, and secured with securing element 16*a*. The second end 24 of the outer bladder is secured with securing element 16*b*. Caps may be provided at one or both ends 30, 32 of the paintball grenade 10, as shown in FIG. 11.

In use, when a paintball sport player, for example, wants to throw the grenade 10 at another player to mark the player, the cap 28 is removed from the second end 24 of the outer bladder 14. Upon impact, the resultant impact force and hydrostatic pressure exerted by the colored liquid 42 against the wall of the inner bladder rupture the closed end 20 of the inner bladder 12, discharging the colored liquid 42 and marking the target. It is appreciated that both ends 18, 20 of the inner bladder may rupture on impact, discharging the colored liquid 42 and marking the target. The thicker outer bladder 14 does not rupture in use, and thus, colored liquid 42 is forced out of primarily the non-secured closed end 20 of the inner bladder 12, and out the second end 24 of the outer bladder 14.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A paintball grenade, comprising:

an outer bladder having a first open end and an opposite second open end, the outer bladder having a cavity therethrough;

an inner bladder having a closed end and an open end, the inner bladder capable of being inserted into the outer bladder whereby the open end is adjacent the first open end of the outer bladder, and the closed end is adjacent the second open end of the outer bladder, the inner bladder being filled with a colored liquid;

a securing element concurrently securing the first open end of the outer bladder and the open end of the inner bladder.

2. The paintball grenade of claim 1, wherein the securing element is a cable tie.

3. A paintball grenade, comprising:

an inner bladder having a closed end and an open end, the inner bladder filled with a colored liquid;

an outer bladder having a first open end and a second open end formed coaxially about the inner bladder, whereby the open end is adjacent the first open end of the outer bladder, and the closed end is adjacent the second open end of the outer bladder;

a securing element sealing the first open end of the outer bladder and the open end of the inner bladder.

4. The paintball grenade of claim 3, wherein the securing element is a cable tie.

5. A method of forming a paintball grenade, comprising:

providing a an outer bladder having a first open end and a second open end, the outer bladder having a cavity therethrough;

inserting an inner bladder having an open end and a closed end into the outer bladder whereby the open end is adjacent the first open end of the outer bladder, and the closed end is adjacent the second open end of the outer bladder;

filling the inner bladder with a colored liquid via its open end; and securing the open end of the inner bladder and the first open end of the outer bladder concurrently with a securing element.

6. The method of claim 5, wherein the securing element is a cable tie.

* * * * *